US005221156A

United States Patent [19]

Martin

[11] Patent Number: 5,221,156

[45] Date of Patent: Jun. 22, 1993

[54] CONCRETE FINISHING MACHINE

[76] Inventor: Harlan S. Martin, Rte. #2, Box 2031, Hartwell, Ga. 30643

[21] Appl. No.: 756,605

[22] Filed: Sep. 9, 1991

[51] Int. Cl.[5] ..... E01C 19/22

[52] U.S. Cl. ..... 404/97; 404/112

[58] Field of Search ..... 404/97, 112

[56] References Cited

U.S. PATENT DOCUMENTS

| | | | |
|---|---|---|---|
| 3,412,657 | 11/1968 | Colizza et al. | 404/112 |
| 4,046,483 | 9/1977 | Sutherland | 404/112 |
| 4,331,297 | 5/1982 | Gipson | 404/112 X |
| 4,673,311 | 6/1987 | Whiteman, Jr. | 404/112 |

FOREIGN PATENT DOCUMENTS

| | | | |
|---|---|---|---|
| 2008732 | 1/1970 | France | 404/112 |

OTHER PUBLICATIONS

Stone Professional Finishers, Stone Construction Equipment, Inc., 1984.

*Primary Examiner*—William P. Neuder

*Attorney, Agent, or Firm*—Patrick F. Henry

[57] ABSTRACT

A power unit base supports a power unit which has a power drive extending through a circular spacing member plate mounted above a concrete finishing plate on which are attached concrete finishing members. Spaced handles extend above the finishing plate and provide hand gripping surfaces whereby the unit can be operated while the operator stands above the machine. The engine power shaft extends through bearings and is attached to the finishing plate. Control means for the power unit is mounted on one of the handles.

6 Claims, 2 Drawing Sheets

CONCRETE FINISHING MACHINE

BACKGROUND OF THE INVENTION

1. Field of the Invention

Power driven machines employing a rotatable bottom plate carrying finishing members for engaging the concrete surface. The machine is supported during operation by spaced handles above the machine and there is a free-wheeling circular guide plate on the machine which prevents the rotating plate from coming into contact with walls, electrical or plumbing stubbs while allowing for concrete finishing to within approximately 3 mm. of such obstructions, thus eliminating the need for any additional labor intensive hand finishing.

2. Prior Practices and Procedures

Concrete finishing machines are well known and many employ rotating plates or discs having some arrangement of concrete finishing members that are rotated in engagement with the concrete surface curing to provide an even and smooth finish Such machines are usually controlled by a single handle which projects upwardly and outwardly from the power unit of the machine and require operator strength and stamina during operation. For example, that type of machine is disclosed in the following U.S. Pat. Nos.: 4,740,348; 4,629,359; 4,198,178; 2,667,824; 2,836,056 and 2,662,454 and 2,556,983. Although these machines do a satisfactory job of mechanically finishing the center surfaces of concrete slabs, by the very nature of their design it is impossible to finish surfaces closer than approximately 5 cm. from any vertical obstruction. The design defect requires labor intensive hand finishing for close proximity. The present machine will finish surfaces close to vertical obstructions while providing a means of guiding the machine and preventing damage to the vertical obstruction, thus eliminating the need for expensive time consuming hand finishing.

SUMMARY OF THE INVENTION

A rigid base supports an internal combustion engine which has a power drive connected through the base to a bottom finishing plate and through an intermediate free-wheeling circular guide plate. The bottom finishing plate carries a plurality of spaced finishing members which are rotated by the power unit. Spaced handles extend above the base plate so that the operator bends over the machine and can both apply pressure through the handles to the machine as well as control the machine as to its movement around the concrete surface being finished. Controls are provided on one of the handles and the entire machine may be lifted by one person.

An object of this invention is to provide a concrete finishing machine which is easily controlled by the operator, and is capable of mechanically finishing concrete to very close proximity of vertical obstructions such as a wall, plumbing stubbs or electrical conduit.

Another advantage of the present invention resides in the arrangement of the power unit, base finishing plate and handles whereby the unit may be lifted by a single operator or pushed into the concrete surface and maneuvered on the surface.

Still another object of the present invention is the provision of a free-wheeling circular guide plate which guides this machine smoothly along walls and obstructions such as plumbing stubbs, electrical conduit or wall surfaces, while allowing for concrete finishing to within very close proximity of such obstructions, thus eliminating the need for any additional hand finishing.

Another object of the present invention resides in the handle arrangement which provides the maneuverability and control.

Other and further objects and advantages of this invention will become apparent upon reading the following description of a preferred embodiment taken in conjunction with the accompanying drawings in which.

DESCRIPTION OF A PREFERRED EMBODIMENT

Figure 1:
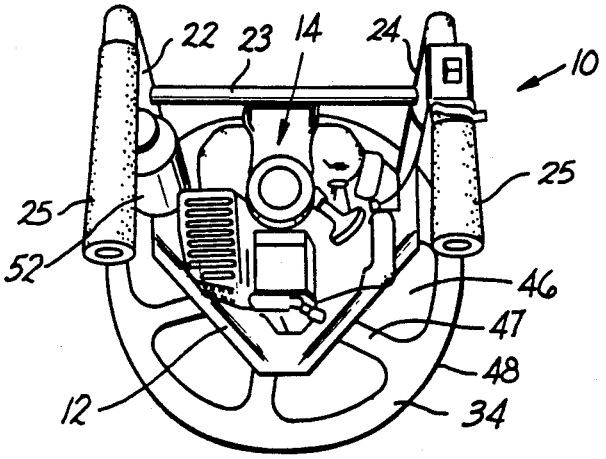
FIG. 1 is a top plan view looking down into the machine from above.
Figure 2:
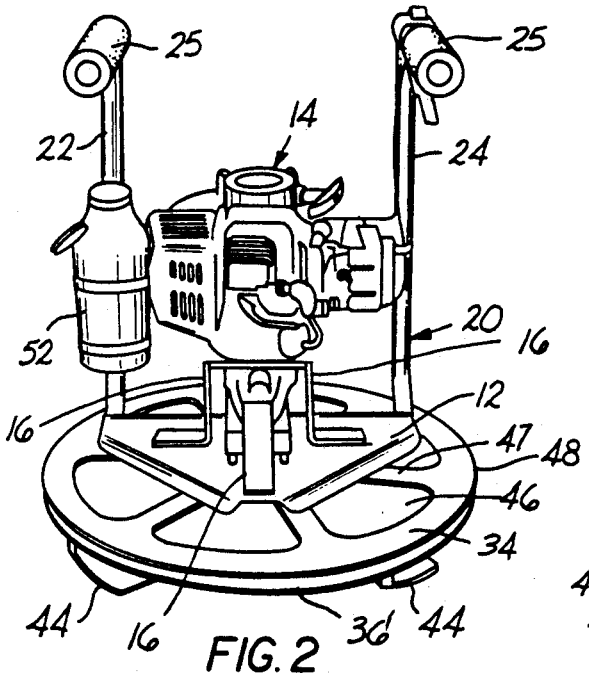
FIG. 2 is a front elevation view in perspective of the machine.
Figure 3:
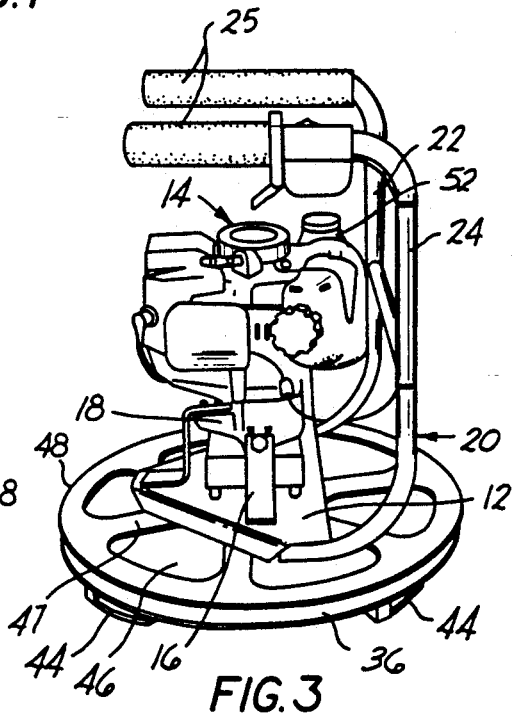
FIG. 3 is a side elevation view in perspective of the machine.
Figure 4:
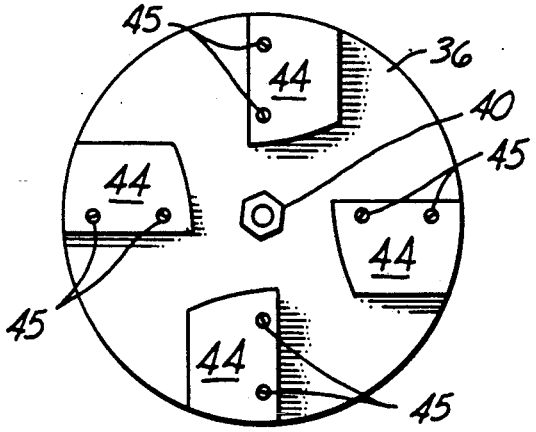
FIG. 4 is a bottom plan view looking upwardly into the bottom of the machine in FIG. 1.
Figure 5:
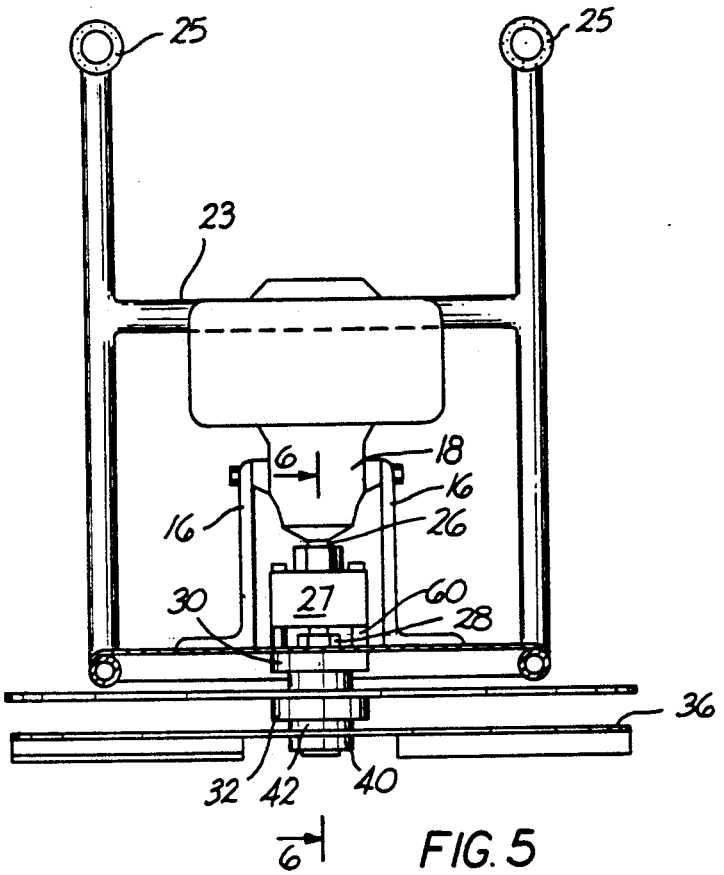
FIG. 5 is an elevation view of the machine partly in cross section mediately through the power drive at the bottom of the machine.
Figure 6:
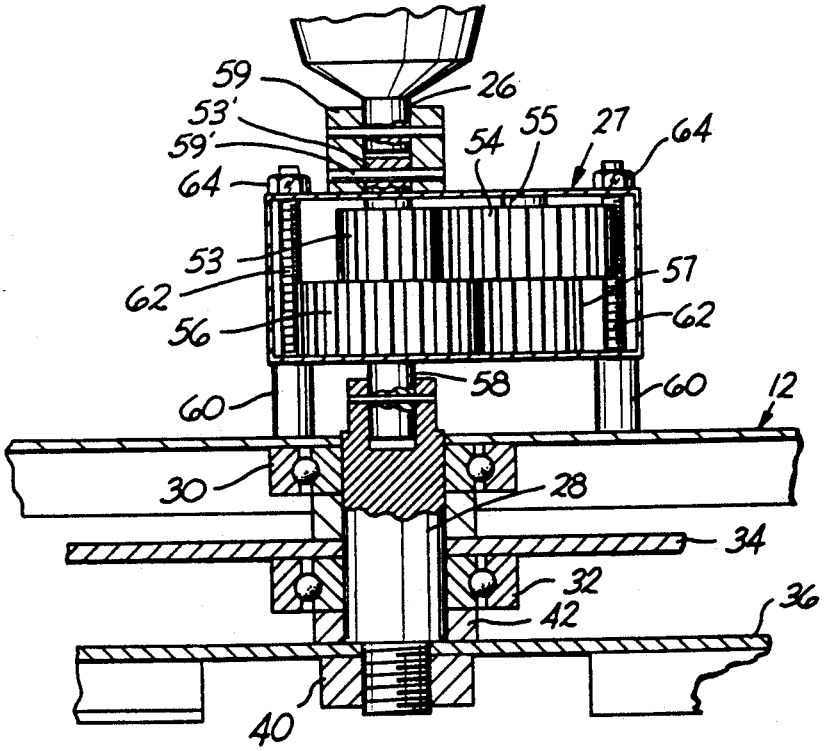
FIG. 6 is a cross-sectional view taken along lines 6—6 in FIG. 5.

The machine 10 comprises a triangular support plate 12 which serves as an engine mounting plate for an internal combustion engine 14 which comprises the usual engine parts that per se do not form a part of this invention due to the fact that any suitable internal combustion engine similar to those used on power units can be used. The present engine is an "ECHO" (trademark) power unit obtainable on the open market. Engine 14 is mounted on angular legs 16 bolted into the respective sides of the housing 18 of engine 14. There are three such legs 16 bolted into the housing 18.

Support plate 12 supports a handle assembly 20 of tubular construction and comprising spaced handles 22, 24 connected by an intermediate brace 23. Handles 22, 24 are attached to support plate 12. Each handle 22, 24 comprises a horizontal gripping member 25 covered with a soft plastic cushion material.

Engine 14 provides a coupled and pinned power output shaft 26 which is atttached to a gear reducer 27 having an output drive shaft 28 supported in a first bearing 30 mounted on support plate 12 and extending through a second bearing 32 mounted on a free-wheeling circular metal guide plate 34 located above a bottom finishing plate 36 which is attached by a nut 40 welded to the finishing plate 36 that is spaced by means of a washer 42 from the bearing 32. Finishing plate 36 has 4 metal finishing members 44 attached by screws 45 to the bottom of the finishing plate 36. Each member 44 has a rounded edge and flat surface which engages the surface of the concrete being finished. The curved ends of each member 44 terminate even with the circumferential edge 36' of the finishing plate 36 so that there is no indentation or projection. Plate 34, which may be constructed of plastic of circular construction having open portions 46 and ribs 47, extends slightly at edge 48 but not very much beyond the terminal circumferential edge of the finishing plate 36 so as to engage obstructions such as plumbing, electrical conduit or walls and thereby prevent the finishing plate 36 from striking or hitting same while allowing for finishing to within 3 mm. of such obstructions without the need for further hand finishing.

A container 52 is removably attached to handle 22.

Gear reducer 27 comprises an 18 tooth gear 53 on shaft 53'; a 30 tooth gear 54 and 18 tooth gear 57 on shaft 55; a 30 tooth gear 56 on gear box output shaft 58 which is pinned into shaft 28. Shaft 26 is coupled to shaft 53' by a coupling 59 having a pin 59'. Gear box 27 is supported on spaced posts 60 on plate 12 by bolts 62 and nuts 64.

While I have shown and described a particular eembodiment of this invention together with suggested ways of operating the machine, this is by way of illustration only and does not constitute a limitation on the invention since there are various alterations, changes, deviations, revisions and departures which may be made in the preferred embodiment without avoiding the scope of this invention as defined only by proper interpretation of the appended claims.

The invention claimed is:

1. In a concrete finishing machine:

a power unit base, a power unit mounted on said base and having a power drive means extending therefrom, spaced handle means extending above said base comprising individual, separate and spaced substantially vertical handle members attached to opposite sides of and extending above said power unit, means connecting said handle members, said spaced handle members extending above said unit having hand gripping means thereon extending at an angle thereto to be grasped by the hands of an operator standing at said unit so as to apply pressure and guide the unit, a spacing means on said machine for spacing said machine away from obstructions during operation of the machine, a power unit on said machine, a finishing plate on said power unit base for power driven rotation thereon, said finishing plate having finishing members mounted thereon for engagement with the surface of concrete for finishing same and said spacing means preventing said finishing plate from engaging an obstruction such as a wall.

2. In a concrete finishing machine:

a power unit plate having a power unit mounted thereon, said power unit having an output shaft extending through said plate, opposed handle members attached to said plate and extending substantially vertically thereabove when said machine is in position for finishing concrete, said handles having gripping means thereon, a circular spacing plate mounted for free movement beneath said power unit plate and having said power drive extending therethrough, a circular finishing plate mounted beneath said spacing plate and having said power drive attached thereto, bearing means respectively on said finishing plate and said spacing plate, and finishing members attached to said finishing plate for engaging the surface of concrete to be finished.

3. The machine in claim 7, including:

a gear reducer connected to said power unit and said finishing plate.

4. In a concrete finishing machine:

a power unit base, a power unit mounted on said base and having a power drive means extending therefrom, spaced handle means extending above said base comprising individual, separate spaced hand gripping members on opposite sides of and above said power unit, said spaced hand gripping members extending above said unit respectively to be grasped by respective hands of an operator standing over said unit so as to apply pressure and guide the unit, a spacing means on said machine for spacing said machine away from obstructions during operation of the machine, a power unit on said machine, a finishing plate on said power unit base for power driven rotation thereon, said finishing plate having finishing members mounted thereon for engagement with the surface of concrete for finishing same and said spacing means preventing said finishing plate from engaging and obstruction such as a wall, said spacing means being a moveable circular member mounted between said power unit and said finishing plate.

5. The machine in claim 4, wherein:

said circular member is a freely movable guide above said finishing plate.

6. The machine in claim 5, wherein:

there is a gear reducer attached to said power unit and said finishing plate.

* * * * *